US006733376B2

(12) United States Patent
Williams

(10) Patent No.: US 6,733,376 B2
(45) Date of Patent: May 11, 2004

(54) HAND SANDING TOOL

(76) Inventor: John Douglas Williams, 3701 Mid Dale Ct., Louisville, KY (US) 40220

( * ) Notice: Subject to any disclaimer, the term of this patent is extended or adjusted under 35 U.S.C. 154(b) by 0 days.

(21) Appl. No.: 10/223,066

(22) Filed: Aug. 16, 2002

(65) Prior Publication Data

US 2003/0054742 A1 Mar. 20, 2003

Related U.S. Application Data

(63) Continuation-in-part of application No. 09/846,814, filed on May 1, 2001, now abandoned.
(60) Provisional application No. 60/312,931, filed on Aug. 16, 2001.

(51) Int. Cl.[7] ..... B24D 15/00
(52) U.S. Cl. ..... 451/344; 451/521; 451/522; 451/523; 451/524
(58) Field of Search ..... 451/344, 355, 451/521, 522, 523, 524

(56) References Cited

U.S. PATENT DOCUMENTS

| | | | | |
|---|---|---|---|---|
| 581,840 | A | * | 5/1897 | Adams |
| 2,447,327 | A | * | 8/1948 | Gerrits et al. |
| 3,699,729 | A | * | 10/1972 | Garvey et al. |
| 4,974,374 | A | * | 12/1990 | Meyer |
| 5,980,370 | A | * | 11/1999 | Chang ..... 451/344 |

* cited by examiner

*Primary Examiner*—Eileen P. Morgan
(74) *Attorney, Agent, or Firm*—Carrithers Law Office PLLC; David W. Carrithers

(57) ABSTRACT

A hand sanding tool that has a strip of material secured to a frame and spanning across an open gap of the frame. The strip of material has an abrasive surface for sanding objects and a spring force applies tension to the strip. The spring force maybe a resiliently flexible frame or a separate spring element anchoring the strip to the frame. Quick connect-quick release connectors connect the strip to the frame.

12 Claims, 4 Drawing Sheets

HAND SANDING TOOL

This is a Continuation-In-Part of U.S. application Ser. No. 09/846,814 filed on May 1, 2001 now abandoned which also claims priority from U.S. Provisional Application Serial No. 60/312,931 filed on Aug. 16, 2001, both of which are incorporated by reference herein.

BACKGROUND OF THE INVENTION

1. Technical Field

This invention relates generally to hand tools and more particularly to a hand tool for sanding an object.

2. Background Information

There are a variety of hand tools for sanding that include a frame and means thereon for detachably connecting thereto a strip or sheet, or a portion of a sheet, of material having an abrasive coating on one face thereof. The known tools have a base plate that serves as a backing for the sheet of abrasive material and such base plate in some instances is rigid while in others it is flexible. Also in some instances the base plate is flat while in others it is curved.

Hand tools are also known that consist of a C-shaped frame with a cutting element detachably secured thereto and wherein the cutting element spans across the bite of the C-shaped frame. Examples of such known tools are hack saws, bow saws and coping saws. These well known tools include means to adjust the tension of the cutting element which in most instances is in the form of a blade with saw teeth on one edge thereof. In some instances the cutting element is in the form of a cylindrical rod with cutting formations around the outer periphery but in all instances considerable tension is applied to the cutting element.

Power sanders are known that include an endless belt running on spaced apart pulleys and with a free span between two pulleys, (or equivalent support) that is used to sand an object. In machines of this type the work piece must be brought to the tool and this is not always convenient and many times not even possible.

SUMMARY OF INVENTION

The present invention is to provide a hack saw type frame with adapters detachably anchoring thereto a strip of material having abrasive material on a face thereof and spring means to tension the strip.

In keeping with the forgoing there is provided in accordance with one aspect of the present invention a hand tool comprising a frame having a free open gap in a selected portion thereof, a strip of material having an abrasive surface, means anchoring the strip to the frame at first and second positions located respectively on opposite sides of the open gap whereby the strip has a free length spanning across the gap. Included are means on the frame for resiliently applying tension to the strip extending between the first and second positions. The tension applying means may be the frame, means for biasing such as a coiled spring or flexible longitudinal member incorporated in the frame, or be a separate spring element in cooperative engagement with ends of the frame.

An object of the present invention is to provide a hand tool for sanding in which there is a frame having an open bite portion and means on the frame detachably anchoring a strip of abrasive material to the frame with the strip positioned to span the open bite.

A further object of the present invention is to provide a hand tool of the forgoing type that includes means to resiliently apply tension to the strip of abrasive material attached thereto.

A further object of the present invention is to provide a hand tool of the forgoing type and wherein the frame has a resiliently flexible portion that tensions the strip spanning the open bite portion of the frame.

A further object of the present invention is to provide a hand tool that has a frame with an open gap, means on the frame and located on respective opposite sides of the gap to detachably anchor a strip of abrasive material to the frame at respective first and second positions spaced apart from one another longitudinally along the strip and means to resiliently apply tension to the strip extending from one to the other of the strip anchoring means.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
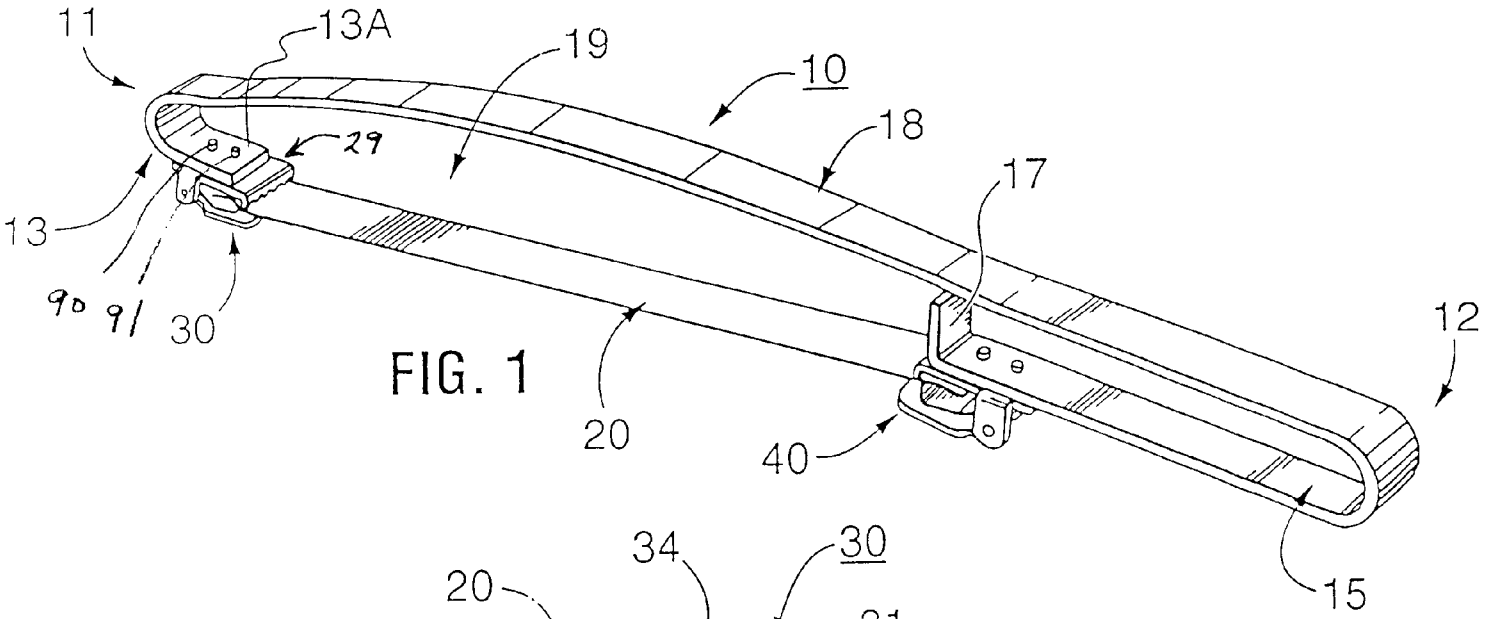
FIG. 1 is an oblique view of a hand tool provided in accordance with the present invention for sanding.
Figure 3:
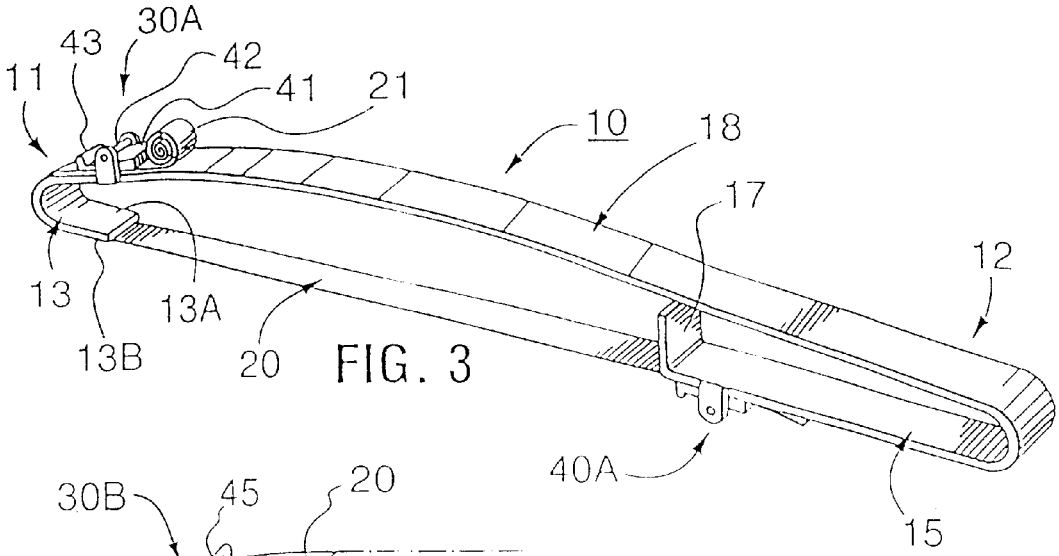
FIG. 3 is an oblique view of the hand tool with alternative means for anchoring the strip to the frame and permitting using a roll of the strip material.

Referring to FIGS. 1 and 3 there is illustrated a hand tool for sanding objects and comprises a frame 10 having a strip 20 of material, with an abrasive material on a face thereof, detachably anchored to the frame by a pair of spaced apart anchoring means 30 and 40 which define a clasp 29.

The frame 10 has a toe end designated 11 and a heel end designated 12. At the toe end of the frame there is a reversely bent portion 13 that has an inner and an outer surface designated respectively 13A and 13B. At the heel 12 of the frame there is a reversely bent portion 15 that terminates in an inner end portion 17. The heel portion of the frame provides a handle.

The toe and heel defining portions of the frame are interconnected by an arched portion 18 that is resiliently flexible under hand pressure. The frame 10 has an open gap 19 between the pair of strip anchoring means 30 and 40 that is spanned by the strip 20 and the resiliency of the frame applies tension to this free span of the strip. The strip for example maybe a strip of sand paper, emery cloth or the like.

Figure 2:
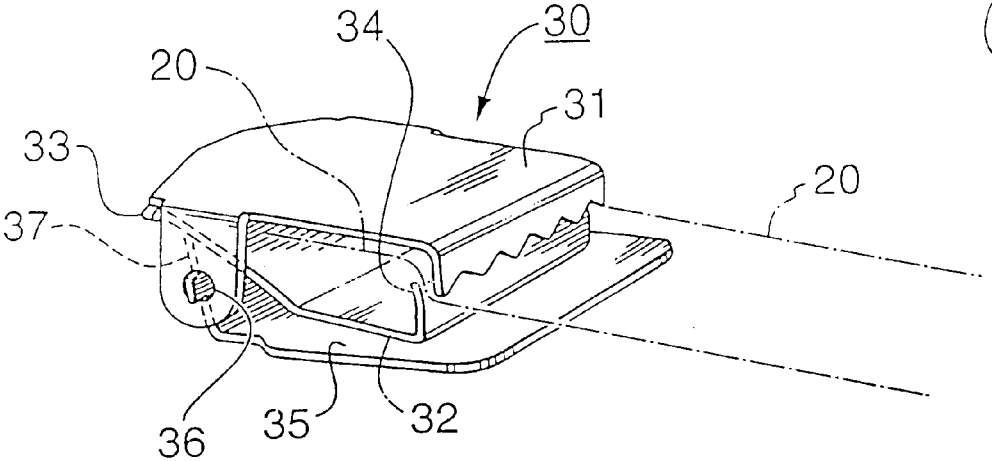
FIG. 2 is an oblique view of one of the strip anchoring means shown in FIG. 1 but on a larger scale.

The strip anchoring means 30 and 40 in FIG. 1 are the of the same construction differing only in their location on the frame and further constructional details of the same can be seen in FIG. 2. Referring to FIG. 2 the anchoring means defines a clasp 29 having a base 31, an L-shaped gripping element 32 and a lever arm 35. The gripping element 32 is pivotally connected at one end thereof by suitable means as at 33 to the base 31 and terminates at the other end in a serrated edge 34 that engages the strip 20. The lever arm 35 is pivotally mounted on the base as at 36 and has an end portion 37 that engages the member 32 to selectively engage and release the strip 20 and, in an over-center action, locks the gripping element on the strip. The base 31 is secured to the frame as by means for attachment such as by pins, bolts, rivets and/or welding. As shown in FIG. 1, a pair of pins 90, 91 spaced apart from one another extend through the base 31 and frame 13 to hold the clasp 29 immovably thereto.

Referring to the embodiment shown in FIG. 3 the strip of material 20 is dispensed from a roll 21 of the same through a wedge type anchoring means 30A and it is anchored at the other end by another wedge anchoring means 40A of the same construction but located adjacent the heel portion of the hand tool. In this embodiment the strip 20 abuts against the lower face 13B of the frame and can be used for sanding where more pressure maybe applied during sanding than is possible with the free unsupported length of the strip. The free unsupported length is particularly useful for sanding the surface of round or rounded objects.

Each anchor 30A and 40A has a wedge 41 located in a gap between the frame and a rod (or roller) 42 attached to the frame. The wedge is reciprocally movable along the frame from one position to another to respectively clamp the strip to the frame and release the same with the strip disposed between the wedge and the frame. The wedge is held captive between the frame and the rod 42 by an enlargement 43 at the apex of the wedge. This enlargement 43 can also be used, as shown in FIG. 6, to locate the sanding face of the strip in a plane offset from the face 13B of the frame to avoid having the frame striking the work piece and damaging the same during use.

Figure 4:
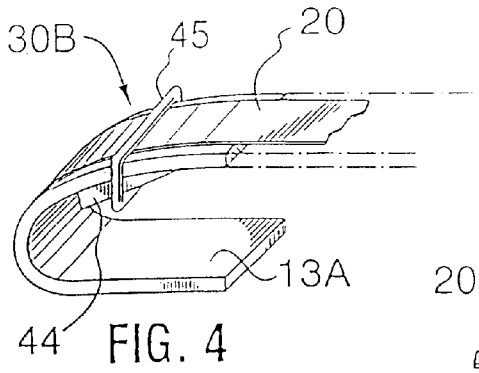
FIG. 4 is an oblique view of one end of the frame illustrating means of anchoring the strip of abrasive material to the flexible frame of FIGS. 1 and 3.
Figure 5:
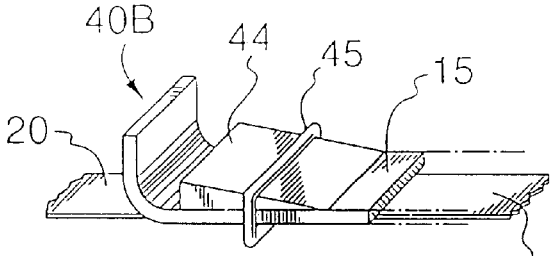
FIG. 5 is an oblique view of one end of the frame illustrating means of anchoring the strip of abrasive material to the flexible frame of FIGS. 1 and 3.
Figure 6:
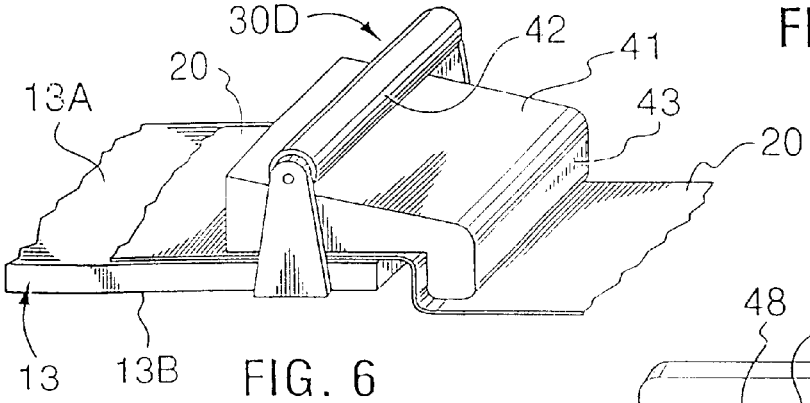
FIG. 6 is an oblique view of one end of the frame illustrating means of anchoring the strip of abrasive material to the flexible frame of FIGS. 1 and 3.

The strip anchoring means illustrated in FIGS. 3 and 6 utilize a reciprocally movable wedge to clamp the strip onto the frame. In the embodiment shown in FIGS. 4 and 5 the wedge is fixed to the frame and anchoring is effected by a closed loop around the frame and moveable relative thereto along a length portion of the wedge. Referring to FIG. 4 there is illustrated an anchoring means 30B adjacent the toe end of the frame and includes a wedge 44 fixed to the frame and located on the inner surface thereof opposite the surface 13A and a closed loop 45 that encircles the frame portion that has the wedge fixed thereto. The loop is movable along the frame releasably locking the strip, located in the gap between the loop and the frame, to the frame. In FIG. 5 a wedge 44, for the anchoring means designated 40B, is fixed to the handle portion 15 of the frame and a closed loop 45 encircles that portion of the frame and the wedge 44 secured thereto.

Figure 7:
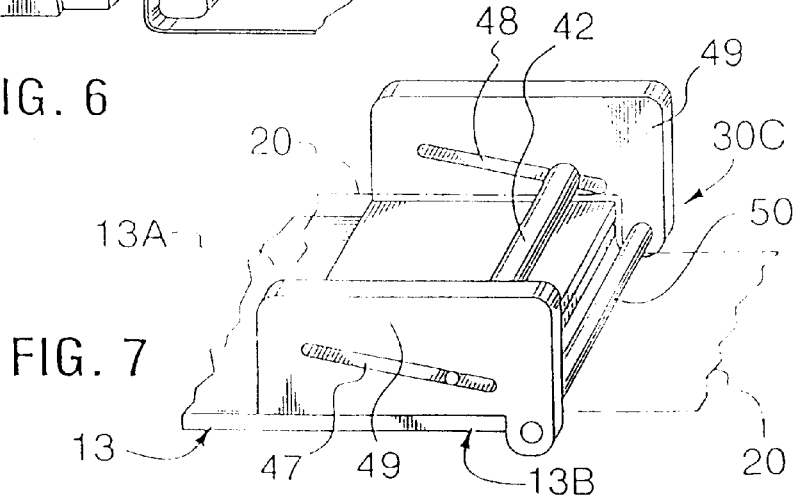
FIG. 7 is an oblique view of one end of the frame illustrating means of anchoring the strip of abrasive material to the flexible frame of FIGS. 1 and 3.

Referring to FIG. 7 there is illustrated a strip anchoring means 30C mounted on the frame portion 13 and in which a roller 42 has opposite ends thereof slidable in slots 47 and 48 in respective ones of a spaced apart pair of lugs 49 secured to and projecting from the frame. The slots slope relative to the flat planar surface of the frame adjacent thereto and disposed there between. If desired a rod 50 can be secured at opposite ends thereof to the spaced apart pair of lugs 49. The rod 50 is so located as to hold the strip 20 in a plane offset from the lower face 13B of the frame leg portion 13. The roller 42 being movable in the cam slots 47,48 releasably locks the strip 20 to the frame.

It will be readily apparent the various illustrated strip locking means maybe used in pairs of the same construction or in various combinations of the different constructions illustrated or their mechanical equivalents to anchor opposite ends of the abrasive strip 20 to the frame. In the forgoing embodiment the resiliency of the frame applies tension to the strip and thus the locking means are biased, when in their locking position, to maintain their locking function.

Figure 8:
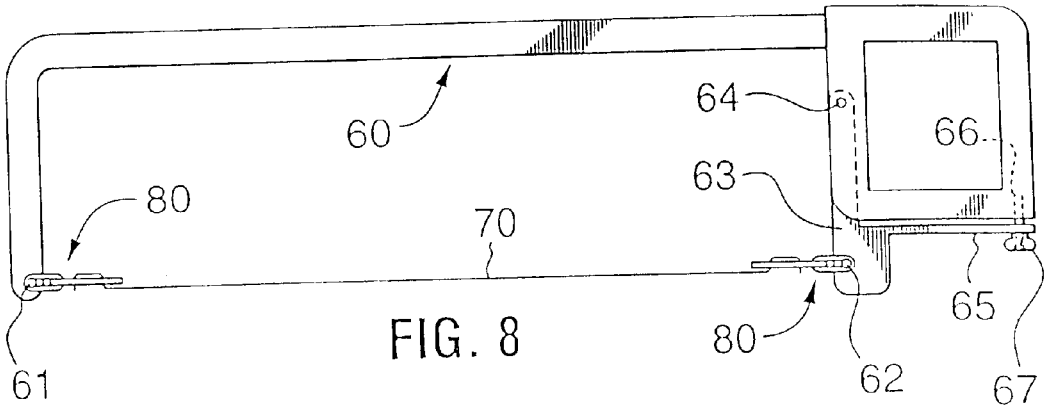
FIG. 8 is side elevational view of a hacksaw type frame with a pair of adapters connecting a strip of abrasive material thereto and spring means resiliently tensioning said strip.
Figure 9:
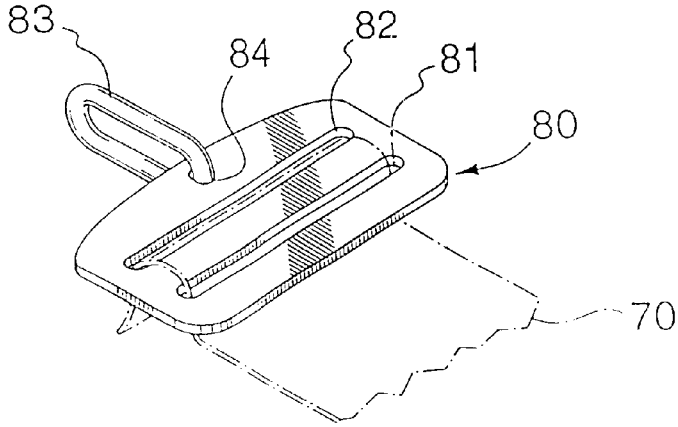
FIG. 9 is an oblique view of one of the pair of adapters shown in FIG. 8 but on a larger scale.

Referring to FIG. 8 there is illustrated a frame 60 that has a pair of spaced apart pins 61 and 62 thereon and a strip 70 of abrasive material anchored at opposite ends thereof to the frame by a pair of connectors 80. Each connector 80 comprises a plate having therein a spaced apart pair of parallel slots 81, 82 and a closed loop 83 that passes through a hole 84 in the plate. The closed loop engages one of the pins 61, 62 that is associated therewith. The pin 62 is located in a lever arm 63 that is pivotally attached to the frame by a pin 64. A leaf spring 65 is fixedly secured to and projects from the lever arm 63. This leaf spring 65 provides means of resiliently tensioning the strip of abrasive material for sanding. A threaded stud 66 projects through a hole in the leaf spring and threads into a threaded bore in the handle of the frame thereby provides means to adjustably vary the tension of the strip. The frame 60 is the same as a conventional well known hack saw frame differing therefrom in the leaf spring 65 (or mechanical equivalent thereof) that resiliently applies tension to the strip 20. The stud 66 has a head end provided with wings 67 for finger manipulation of the stud. A compression coil spring (not shown) can, if desired, be placed on the stud 66 between the head thereof and the leaf spring and used in association with the leaf spring or in place thereof in which case the leaf spring 65 could be replaced by a rigid member.

The strip 70 of abrasive material is threaded through the slots 81 and 82 and thereby is detachably and adjustably anchored to the plate which in turn is detachably connected to the frame by a loop 83 (or mechanical equivalent thereof). All of the forgoing connectors that connect the strip to the frame are a quick connect-quick release connectors.

Figures 10, 11:
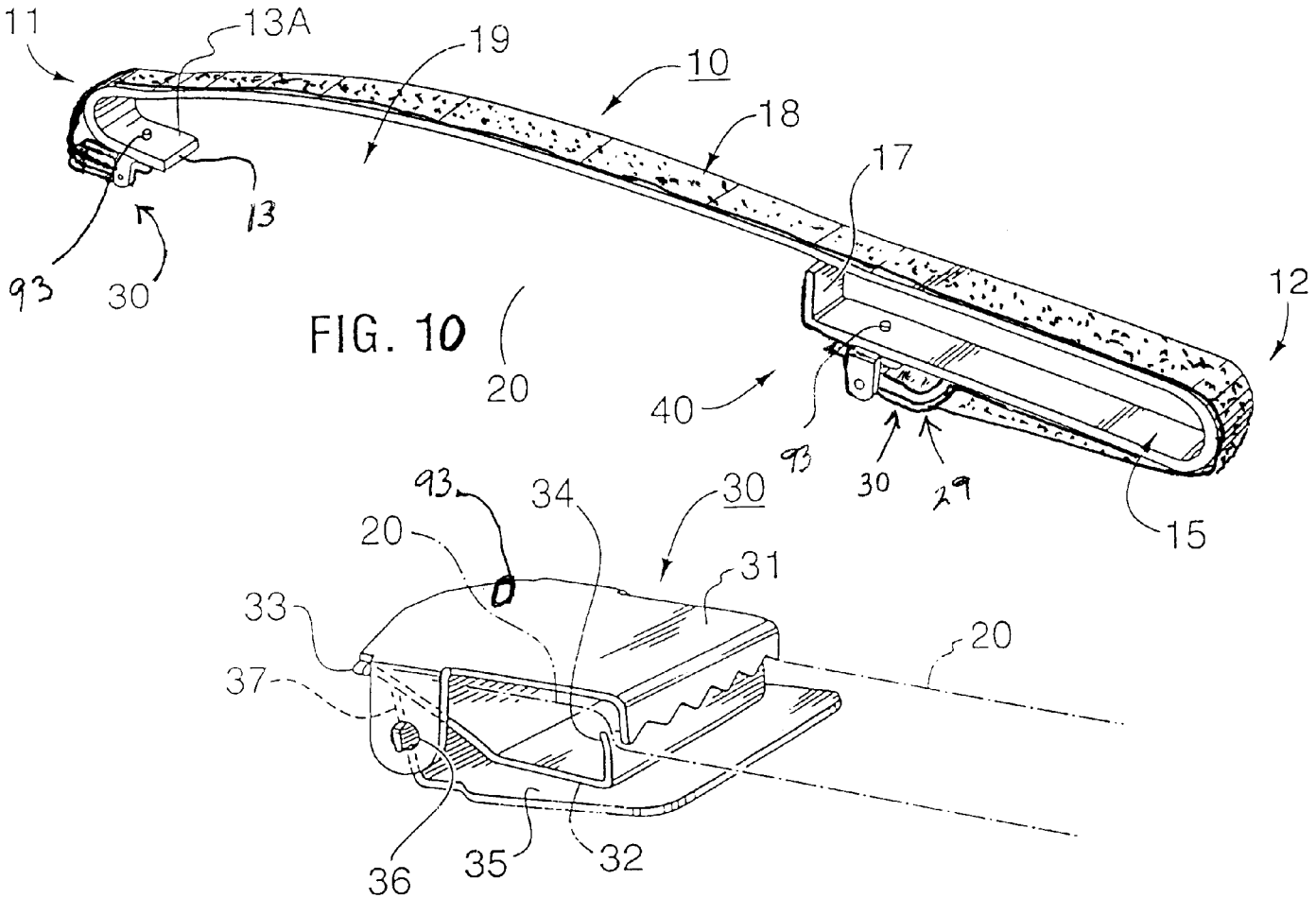
FIG. 10 is a perspective view of hand sanding tool showing clamps at each end held by a single rivet providing a swivel to invert and hold the ends of a strip of sand paper and wrap the strip over the outer surface of the frame, thereby providing a continuous sanding strip supported by the flat smooth frame.
FIG. 11 is a perspective bottom view of the clasp portion of the hand sanding tool of FIG. 10 showing the clamps and single swivel pin.

As illustrated in FIGS. 10–11, the hand sanding tool can be fabricated utilizing a single rivet to attach the clasps 29 having clamps to the frame by a single pin 93 extending through the base and frame and being secured thereto providing a rotating member defining a swivel to invert and hold the ends of a strip of sand paper and wrap the strip over the outer surface of the frame, thereby providing a continuous sanding strip supported by the flat smooth frame. FIGS. 10–11 show the clasps 29 swivelled 180 degrees facing outwardly to secure the inverted strip of sand paper so that the flat side of the sand paper is continuous with the outer surface of the longitudinal frame extending there along the handle portion to another clamp rotated so that the clamp portion is facing outwardly for securing the distal end of the strip of sandpaper.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A hand sanding tool, comprising:

a frame member extending generally longitudinal having a first toe end and a second heel end; said first toe end defining a first reversely bent portion, said second heel end defining a second reversely bent portion of greater extent than said first reversely bent portion to form a handle;

said frame further comprising a central arched portion extending between and connecting said handle and first toe end, wherein a gap is formed opposite said central arched portion between said toe end and said heel end;

anchoring means comprising two clasps, each clasp detachably and reversibly connected at said first toe end and said second heel end, respectively, for anchoring ends of an abrasive strip;

said central arched portion defining flexible means for resiliently applying tension to the strip extending;

1) across said gap between said anchoring means when said clasps are in a first position, or 2) along an outer surface of said frame from said toe end to said central arched portion to said handle to said heel end, when said clasps are in a second, reversed position.

2. The hand sanding tool as defined in claim 1 wherein said strip anchoring means comprises a wedge and a rod mounted on said frame and together providing a gap through which a portion of said strip passes.

3. The hand sanding tool as defined in claim 2 wherein said wedge is reciprocally movable along a selected length portion of said frame.

4. The hand sanding tool as defined in claim 3 including means retaining said wedge captive and limiting reciprocal movement of the same.

5. The hand sanding tool as defined in claim 4 wherein said retaining means comprises an enlargement located on an apex portion of the wedge.

6. The hand sanding tool as defined in claim 2 wherein said wedge is fixed to said frame and wherein said rod comprises a portion of a member that circumscribes a portion of the wedge and the portion of the frame associated therewith.

7. The hand sanding tool as defined in claim 1 including adjustable means to vary the tension of said strip spanning between said first and second ends.

8. The hand sanding tool as defined in claim 1 wherein said strip anchoring means comprises a plate having a spaced apart pair of parallel slots therein and through which a portion of the strip is threaded and means attaching said plate to said frame.

9. The hand sanding tool as defined in claim 8 wherein said means attaching said plate to said frame comprises a ring.

10. A hand sanding tool, comprising:

a frame member extending generally longitudinal having a first toe end and a second heel end; said first toe end defining a first reversely bent portion, said second heel end defining a second reversely bent portion of greater extent than said first reversely bent portion to form a handle;

said frame further comprising a central arched portion extending between and connecting said handle and first toe end, wherein a gap is formed opposite said central arched portion between said toe end and said heel end;

anchoring means comprising two plates, each plate detachably and reversibly connected at said first toe end and second heel end, respectively, for anchoring ends of an abrasive strip, wherein each of said plates has a pair of parallel spaced apart slots through which the abrasive strip is threaded;

said central arched portion defining flexible means for resiliently applying tension to the strip extending:

1) across said gap between said anchoring means when said clasps are in a first position or 2) along an outer surface of said frame from said toe end to said central arched portion to said handle to said heel end, when said clasps are in a second, reversed position.

11. The hand sanding tool as defined in claim 10 including adjustable means to vary the tension of said strip spanning between said first and second ends.

12. The hand sanding tool as defined in claim 10 wherein said means attaching said plate to said frame comprises a ring.

* * * * *